US006160757A

United States Patent [19]

Täger et al.

[11] Patent Number: 6,160,757

[45] Date of Patent: Dec. 12, 2000

[54] ANTENNA FORMED OF A PLURALITY OF ACOUSTIC PICK-UPS

[75] Inventors: Wolfgang Täger, München, Germany; Grégoire Le Tourneur, St. Quay-Perros, France

[73] Assignee: France Telecom S.A., France

[21] Appl. No.: 09/137,036

[22] Filed: Aug. 20, 1998

[30] Foreign Application Priority Data

Sep. 10, 1997 [FR] France ..... 97 11458

[51] Int. Cl.[7] ..... H04R 3/12; H04R 5/027

[52] U.S. Cl. ..... 367/119; 367/129; 381/92

[58] Field of Search ..... 367/103, 129, 367/119, 138; 381/26, 92

[56] References Cited

U.S. PATENT DOCUMENTS 5,715,319 2/1998 Chu ..... 381/26

*Primary Examiner*—Ian J. Lobo

*Attorney, Agent, or Firm*—Laff, Whitesel, Saret, Ltd.; J Warren Whitesel

[57] ABSTRACT

The output signals of the acoustic sensors of the antenna are subjected to a processing of the superdirective kind, with a constraint as regards the modulus and a non-linear constraint which fixes the incoherent noise reduction.

The theoretical formulation of these constraints being as follows $$g(f)a_1^H(f) = e^{-j2\pi f\tau} \tag{9}$$

and $$g(f)g^H(f) < \frac{1}{R_{\min}} \tag{10}$$

the first constraint signifying that the total transfer function is a pure delay $\tau$, and the second constraint signifying that a limit is fixed for the incoherent noise reduction.

The antenna is provided to improve the near-field reception.

11 Claims, 10 Drawing Sheets

ANTENNA FORMED OF A PLURALITY OF ACOUSTIC PICK-UPS

Figure 1:
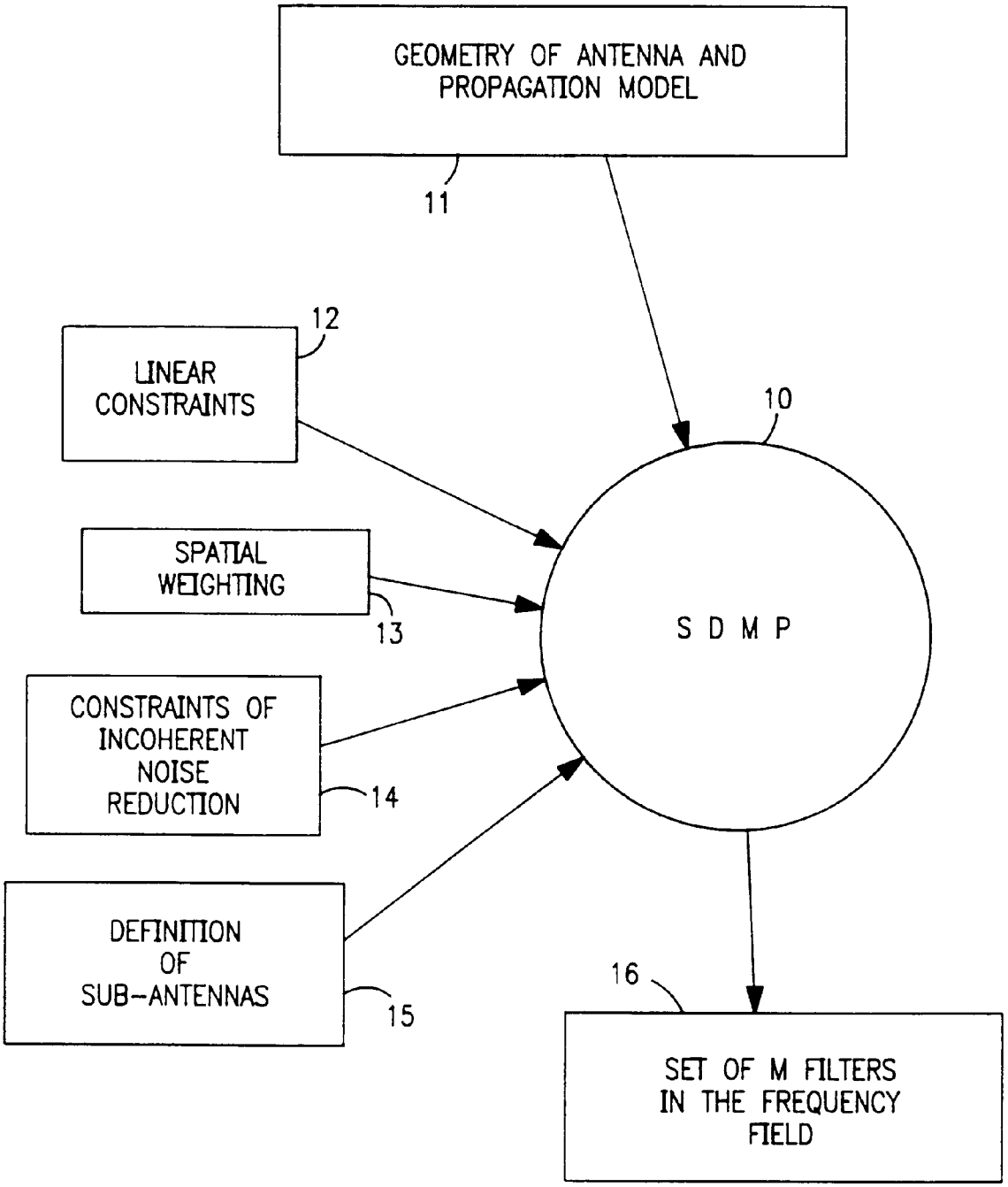

The present invention concerns an acoustic antenna formed from a plurality of discrete acoustic transducers, in particular an acoustic receiving antenna, that is to say, one formed from a plurality of acoustic sensors or microphones. Given the reciprocity principle, the invention also applies to an acoustic transmitting antenna.

The main object of an acoustic receiving antenna is to reduce all receiving faults whilst retaining the wanted information, that is to say the information transmitted by the speaker or by the wanted source.

Hereinafter, in order to better appreciate the difficulties which the invention aims to surmount, a conventional theoretical study of acoustic antenna arrays will be developed, taking the case of an antenna with arbitrary geometry, composed of acoustic sensors which have arbitrary directivity diagrams.

The acoustic signals received on the antenna sensors are impaired by: (1) other transmitters; (2) a multi-path propagation; (3) in some cases, an echo; (4) the electronic noise of the sensors and amplifiers; and (5) possibly, quantification noise for digital processing.

A linear additive model is assumed, that is to say the non-linear degradations are not taken into account. Subsequently, perturbations (1) to (3) will be referred to as "spatially coherent" or simply "coherent" while perturbations (4) and (5) are referred to as "incoherent".

The performance of an antenna as regards a coherent perturbation is given by its directivity diagram. The speaker is assumed to be situated near-field, which means that instead of a direction being of interest, a point in space is of interest instead. It is assumed that the coherent perturbation sources are far-field.

A formula has been adopted which expresses the improvement in the signal to coherent perturbation ratio, under the hypothesis of a diffuse field in comparison with an omnidirectional sensor placed at the site of the closest antenna sensor. The reflections are processed as image sources. It is therefore sufficient to know the free-field propagation law and the directivity diagram of each sensor.

A typical model for the propagation is:

$$x_m(t) = \sum_p x_{p,m}(t) + b_m(t) = \sum_p \frac{u_{p,m}}{d_{p,m}} s_p\left(t - \frac{d_{p,m}}{c}\right) + b_m(t)$$

where $x_m$ signal from the sensor m, also referred to as observation t time $u_{p,m}$ directivity of the sensor m in the direction of the source p $s_p$ signal transmitted by the source p $d_{p,m}$ source p-sensor m distance c propagation speed $b_m(t)$ incoherent noise (electrical and quantification noise) on the sensor m To simplify the calculation, the frequency domain is entered:

$$X_m(f) = \sum_p \frac{u_{p,m}}{d_{p,m}} S_p(f) e^{-j\frac{2\pi f}{c} d_{p,m}} + B_m(f)$$

X,S,B observation, transmitted signal and noise in the frequency domain f frequency The antenna processing may be seen as a scalar product in the frequency domain. The signal at the output of the processing is expressed in the form:

$$Y(f) = \sum_m w_m(f) X_m(f)$$

Let us assume that the wanted source is the source p=l. Conventional antenna processing consists of rephasing the signal, if need be weighting the sensors in order to establish a compromise between the aperture of the main lobe and the level of the secondary lobes, and calculating this sum. It may be expressed by a set of coefficients:

$$w_m(f) = g_m(f) e^{j\frac{2\pi f}{c} d_{1,m}}$$

with $g_m(f)$ real and positive

At the output, the following is therefore obtained:

$$Y(f) = S_1(f) \sum_m g_m(f) \frac{u_{1,m}}{d_{1,m}} + \sum_{p \geq 2} S_p(f) \sum_m g_m(f) \frac{u_{p,m}}{d_{p,m}} e^{j\frac{2\pi f}{c}(d_{1,p} - d_{m,p})} + \sum_m B_m(f) g_m(f) e^{j\frac{2\pi f}{c} d_{1,p}}$$

The three terms of the above sum correspond respectively to the wanted signal, the coherent perturbations and the incoherent noise. This equation may be used for an arbitrary linear processing if complex values are allowed for $g_m(f)$. To obtain the directivity factor, the position of a perturbing source, say for instance p=2, must be varied, and the mean of the remainder of the perturbing signal must be calculated. An amplitude factor is first introduced, the last term of which serves to obtain a factor independent of the distance if it is sufficiently large:

$$\alpha_{p,m} = \frac{u_{p,m}}{d_{p,m}} \min_m \{d_{p,m}\} \tag{1}$$

and the following is obtained, with $$\lambda = \frac{c}{f}:$$

the complex gain of the wanted signal:

$$G_1 = \sum_m g_m(f)\alpha_{1,m}$$

the complex gain of the coherent perturbing signal:

$$G_2 = \sum_m g_m(f)\alpha_{2,m}e^{j2\pi\frac{d_{1,m}-d_{2,m}}{\lambda}} \tag{2}$$

the directivity factor:

$$F = \frac{|G_1|^2}{mean(|G_2|^2)} = \frac{\left|\sum_m g_m(f)\alpha_{1,m}\right|^2}{\frac{1}{4\pi}\int_\varphi\int_\theta\left|\sum_m g_m(f)\alpha_{2,m}e^{j2\pi d_{1,m}-\frac{d_{2,m}}{\lambda}}\right|^2\sin\theta d\varphi d\theta} \tag{3}$$

With the following vector notations:

$$g(f) = (g_1(f), \ldots, g_M(f)) \quad \alpha_1(f) = (\alpha_{1,1}, \ldots, \alpha_{1,M}) \text{ and}$$

$$d_2(f) = \left(\alpha_{2,1}e^{j2\pi\frac{d_{1,1}-d_{2,1}}{\lambda}}, \ldots, \alpha_{2,M}e^{j2\pi\frac{d_{1,M}-d_{2,M}}{\lambda}}\right)^T$$

the following is obtained:

$$F = 4\pi g(f)a_1^H(f)a_1(f)\frac{g^H(f)}{g(f)\int_\varphi\int_\theta d_2(f)d_2^H(f)\sin\theta d\varphi d\theta g^H(f)} \tag{4}$$

and, finally, with the matrices $A(f)=a_I^H(f)a_I(f)$ and $$D(f) = \frac{1}{4\pi}\int_\varphi\int_\theta d_2(f)d_2^H(f)\sin\theta d\varphi d\theta$$

this gives:

$$F(f) = \frac{g(f)A(f)g^H(f)}{g(f)D(f)g^H(f)} \tag{5}$$

As already indicated, these equations are based on a propagation model which is very well adapted in free field with no obstacles. In order to adapt the calculation to a situation in which the model does not prove to be sufficiently accurate, the propagation model may be replaced by measurements. In this case, the vectors $d_2(f)$ represent measured propagation vectors.

This result can be generalised by introducing a weighting $U(f,\phi,\theta)$ of the quadratic error of the integral according to direction:

$$D_U(f) = \frac{1}{4\pi}\int_\varphi\int_\theta U(f,\varphi,\theta)d_2(f)d_2^H(f)\sin\theta d\varphi d\theta \text{ and}$$

-continued $$F_U(f) = \frac{g(f)A(f)g^H(f)}{g(f)D_U(f)g^H(f)}$$

It is assumed that the incoherent noise is uncorrelated from one sensor to another and that its power is equal to $\sigma_b^2(f)$ for all sensors. The incoherent noise reduction is written in this case:

$$R(f) = \frac{\sigma_b^2(f)}{E\left[\left|\sum_m B_m(f)g_m(f)e^{j\frac{2\pi f}{c}d_{1,p}}\right|^2\right]} = \frac{1}{\sum_m|g_m(f)|^2} = \frac{1}{g(f)g^H(f)} \tag{6}$$

From this study, the conventional delay/weighting/summation processing, focusing far-field, can be deduced. For a rectilinear antenna with uniform spacing d of the sensors, the complex gain of the coherent perturbing signal G2 becomes:

$$G_2 = \sum_m g_m(f)\alpha_{2,m}e^{j2\pi\frac{d_{1,m}-d_{2,m}}{\lambda}}$$

and the directivity diagram $\Omega_{f,\phi 0}(\phi)$ for a given frequency can be plotted by varying $\phi$:

$$\Omega_{f,\varphi_0}(\varphi) = 10\log_{10}\left(\left|\sum_m g_m(f)e^{j2\pi\frac{md}{\lambda}\sin(\varphi_0-\varphi)}\right|^2\right)$$

Since 1946, this conventional processing has been the subject of many studies. The method of C. L. Dolph described in the technical journal "Proceedings of the I.R.E. on Waves and Electrons", Vol. 34, n° 6, June 1946, pp. 335–348 is known. In this method, the sensors are spaced equidistantly and their sensitivities are set in accordance with the coefficients of Chebyshev polynomials so as to obtain a response having a main lobe of a given level and a number of secondary lobes of lower levels, in practice equal. As only fractions of the sensor sensitivities are used, the array produces a response which has a signal/noise ratio lower than it would be if the full sensitivity of each sensor were used. Moreover, if the distance between the sensors is too large or too small compared with the wavelength, the performance of the antenna falls.

More recently the document FR-A-2 472 326 describes a method of optimising a linear acoustic antenna geometry, with conventional summation of the sensor signals. It can be considered that a delay/sum linear antenna with variable spacing is concerned. This antenna operates well only in the vicinity of a frequency in a narrow band and the antenna is relatively large in relation to the wavelength.

Still more recently, the document FR-A-2 722 637 describes an antenna geometry in which the sensors are distributed in a horizontal plane on a concave line towards a speaker. The signals from the sensors are summed phase-wise. The antenna is split up into sub-antennas each characterised by a specific spacing between sensors and each allocated to one part of the frequency band. At low frequencies, difficulties are still encountered.

Conventional processings of this type have been studied by other researchers who have chosen different weighting coefficients for modifying the aperture of the main lobe and the level of the secondary lobes of the directivity diagram. It should be noted that, in these processings, the directivity diagrams of the sensors are not used.

When the antenna has to receive broadband acoustic signals, that is to say ones comprising frequencies as low as 20 Hz, two difficulties are encountered with conventional processings: a necessarily high number of sensors in the antenna and a large antenna size. Conventional processings therefore entail an expensive and bulky solution.

As a variant, a so-called "superdirective" antenna processing has been proposed, in which the directivity factor is optimised. On this subject, the work "Antenna Handbook" edited by Y. T. Lo and S. W. Lee in 1993, Vol. II, chapter 11 entitled "Array Theory" and notably pages 11–61 to 11–79 of this chapter 11 may be referred to. According to the present study described above, maximisation of the directivity factor (relationship 5) for a far-field source (the $\alpha$ are all equal to 1) is expressed starting from relationships 4 and 5 by:

$$g^{opt}(f) = \arg\max \frac{g(f)D(f)g^H(f)}{g(f)A(f)g^H(f)} \tag{7}$$

and, setting a transfer function equal to unity in the direction of the wanted signal, by the constraint:

$$g(f)a_f^H(f)=1 \tag{8}$$

By means of this processing, the distance between sensors can be reduced which becomes smaller compared with the wavelength. Thus a good spatial selectivity is obtained with an antenna of small size. The drawbacks of this superdirective antenna are poor robustness, that is to say a rapid decline in performance if the optimisation is not perfect or if the optimum conditions of use are deviated from; amplification of the incoherent noise, and a drop in performance when the information does not come from the end-fire direction.

Among the recent works relating to end-fire acoustic antennas, the article entitled "Practical supergain" by H. Cox et al, published in "IEEE Transactions on Acoustic Speech and Signal Processing", Vol. ASSP-34, n°3, June 1986, pp. 393–398, can be cited. This superdirective antenna is still optimised to aim far-field, since the modulus is not used. Moreover, there are no linear constraints possible and the directivity of the sensors is still not taken into consideration. The weighting is subject only to a constraint on the gain with respect to the uncorrelated white noise.

An attempt has again been made to improve the performance by using adaptive algorithms which make it possible to estimate the field and follow its change. The results are satisfactory if the following three conditions are fulfilled: (1) the number of sources must be small compared with the number of sensors; (2) the ambient noise has more energy than the indirect paths of the wanted source, and (3) the variation in the field is not too rapid. If the first condition is not fulfilled, it is difficult to analyze the field because of ambiguities. The second condition is necessary in order not to confuse the perturbing signal to be minimised with the wanted signal. The third condition is necessary so that the algorithm can follow with an adaptation step small enough to avoid unstable behaviour.

Starting from these basic processings, all valid in far-field: conventional and superdirective processings, and those with adaptive algorithms, development of a lobe formation processing by delay/weighting/summation, focusing in near-field, has been sought. Instead of equalizing the delays for a direction, the delays for a near-field point are equalized. However, while the known processings, mentioned previously, are well understood, since the directivity diagram can be expressed by the Fourier transform of the weighting, few satisfactory results have been published for near-field focusing.

In the article entitled "Near-Field Beamforming for Microphone Arrays" by J. G. Ryan and R. A. Goubran, published in "Proceedings of IEEE ICASSP", 1997, pp. 363–366, the term 1/R is taken into account for the attenuation and therefore the modulus of the signals is used. A rectilinear uniformly spaced conventional antenna geometry is again used. However the directivity diagram of the sensors is not integrated. Moreover, as will be seen subsequently, a function which depends on the signals to be processed is optimised and no additional linear constraints are integrated.

In fact, the processings mentioned up to now do not resolve certain difficulties since, on the one hand, the sound signals to be processed belong to a broadband frequency spectrum, occupying a number of octaves, for example from 100 to 8000 Hz and, on the other hand, there exist near-field sound sources for which the hypothesis of propagation of sound waves by plane waves is not verified. In particular, a small conventional antenna cannot be selective at low frequencies.

One object of the present invention consists of providing an antenna processing which makes it possible to improve the existing conventional processings, starting from a processing of the superdirective kind in which the modulus is processed in order not to introduce any distortion of the wanted signal coming from a near-field acoustic source and which meets a certain number of constraints.

Another object of the invention consists of providing an antenna composed of a plurality of acoustic sensors, the output signals of which are processed, the output signal of the processing being superior in quality to the output signal of an antenna of the prior art when the wanted acoustic source is situated near-field.

Another object of the invention consists of providing an antenna, the processing of which provides a better selectivity at low frequencies.

Another object of the invention consists of providing an antenna having:

a high directivity factor, a wanted signal which is little distorted, and a large incoherent noise reduction.

According to one characteristic of thepresent invention, an antenna is provided formed from a plurality of acoustic sensors, the sensor output signals of which are subjected to a processing of the superdirective kind, with a constraint as regards the modulus and a non-linear constraint which fixes the incoherent noise reduction, the theoretical formulation of these constraints being as follows:

$$g(f)a_f^H(f)=e^{j2\pi f\tau} \tag{9}$$

and $$g(f)g^H(f) < \frac{1}{R_{\min}} \tag{10}$$

the first constraint signifying that the total transfer function is a pure delay $\tau$, and the second constraint signifying that a limit is fixed for the incoherent noise reduction.

According to another characteristic, the processing of the said antenna is also subject to another constraint signifying, for example, the presence of one or a number of zeros in the directivity diagram in one or more given directions, that is to say:

$$C(f)g^H(f)=p(f) \tag{11}$$

where

C(f) is a matrix of propagation vectors, and p(f) is a complex gain vector for each propagation vector.

According to another characteristic, the said processing is realized by a mathematical operator in a so-called superdirective/modulus/phase or SDMP flow diagram, the input data of which are the antenna geometry and propagation model data, the weighting data and the data relating to the constraints mentioned above, and the output data of which are, in the frequency domain, the coefficients of a plurality of digital filters, as many in number as the acoustic sensors.

According to another characteristic, an antenna is provided formed from a plurality of acoustic sensors, a first part of which placed opposite a near wanted source is composed of sensors aligned in a first row and a second part of which placed behind the first row with respect to the near wanted source is composed of sensors aligned in at least a second row.

According to another characteristic, the common direction of the rows of sensors in the first and second parts are transverse to-the mean direction of the wanted acoustic waves.

According to another characteristic, the common direction of the rows of sensors in the first and second parts are slightly oblique with respect to the mean direction of the wanted acoustic waves.

According to another characteristic, the sensors of the first part are distributed symmetrically in a logarithmic manner around the median sensor.

According to another characteristic, the sensors of the first part are selectively allocated to a number of sub-antennas, each sub-antenna being associated with a predetermined frequency band and the sensors selectively allocated to this sub-antenna delivering output signals which are processed by a conventional processing, the frequency bands being contiguous and as a whole not going below 1 kHz in practice, each processing consisting of a specific filtering and the output signals of each specific filter being summed.

According to another characteristic, in the antenna, each sensor output signal is filtered by a filter which performs all of the following: the SDMP algorithm for the low frequencies, division into frequency bands according to the logarithmic antenna method, and conventional channel formation for the frequencies not processed by the SDMP algorithm.

According to another characteristic, a propagation model is used.

According to another characteristic, a measurement of the propagation vectors is used.

Figure 2:
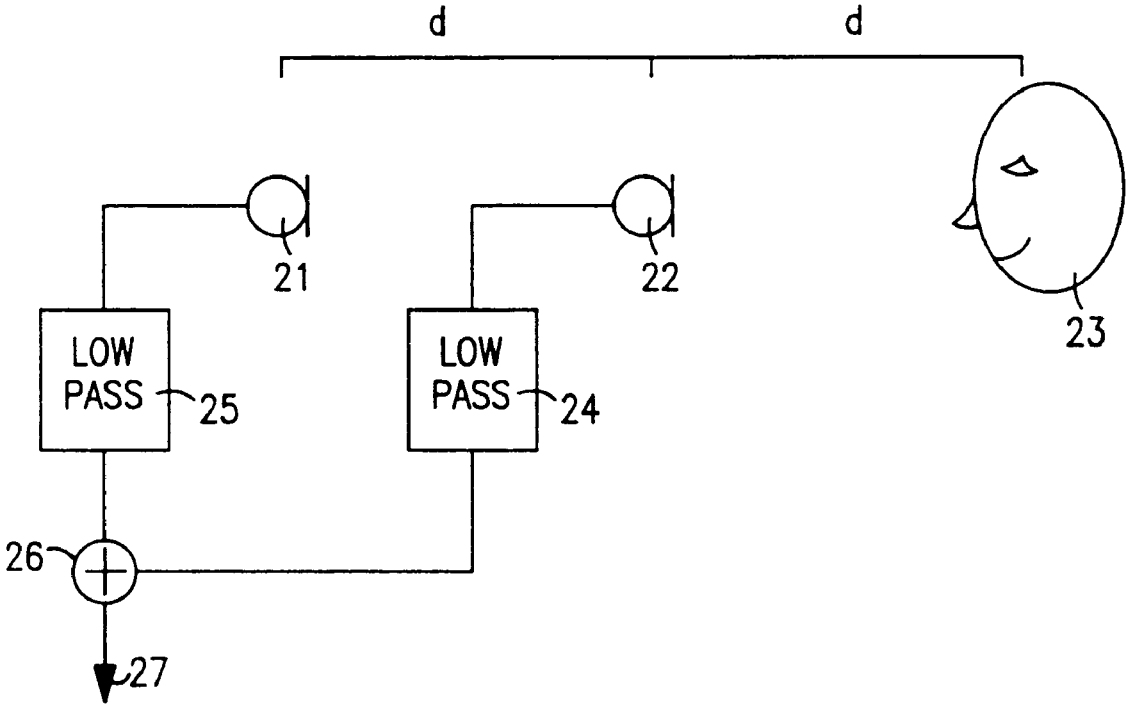
Figure 3:
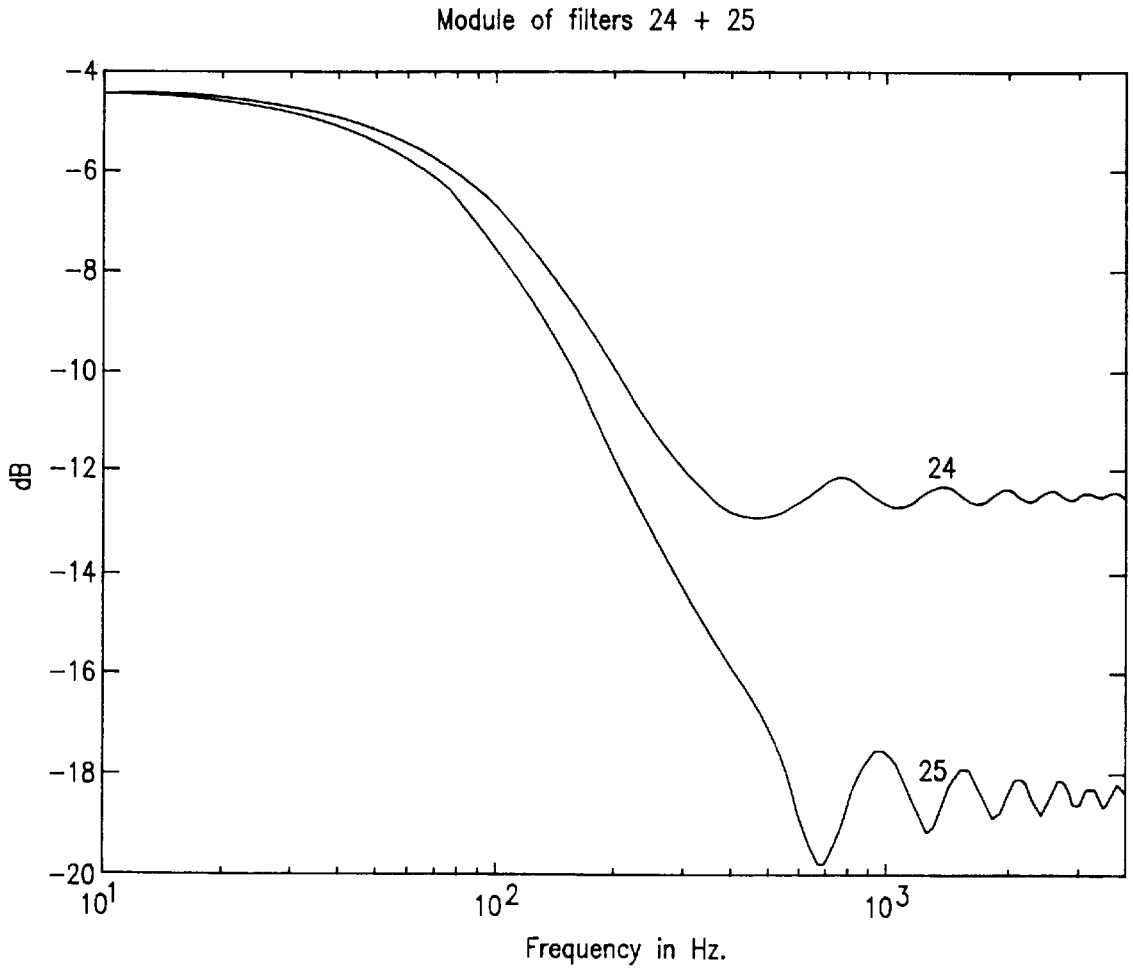
Figure 4:
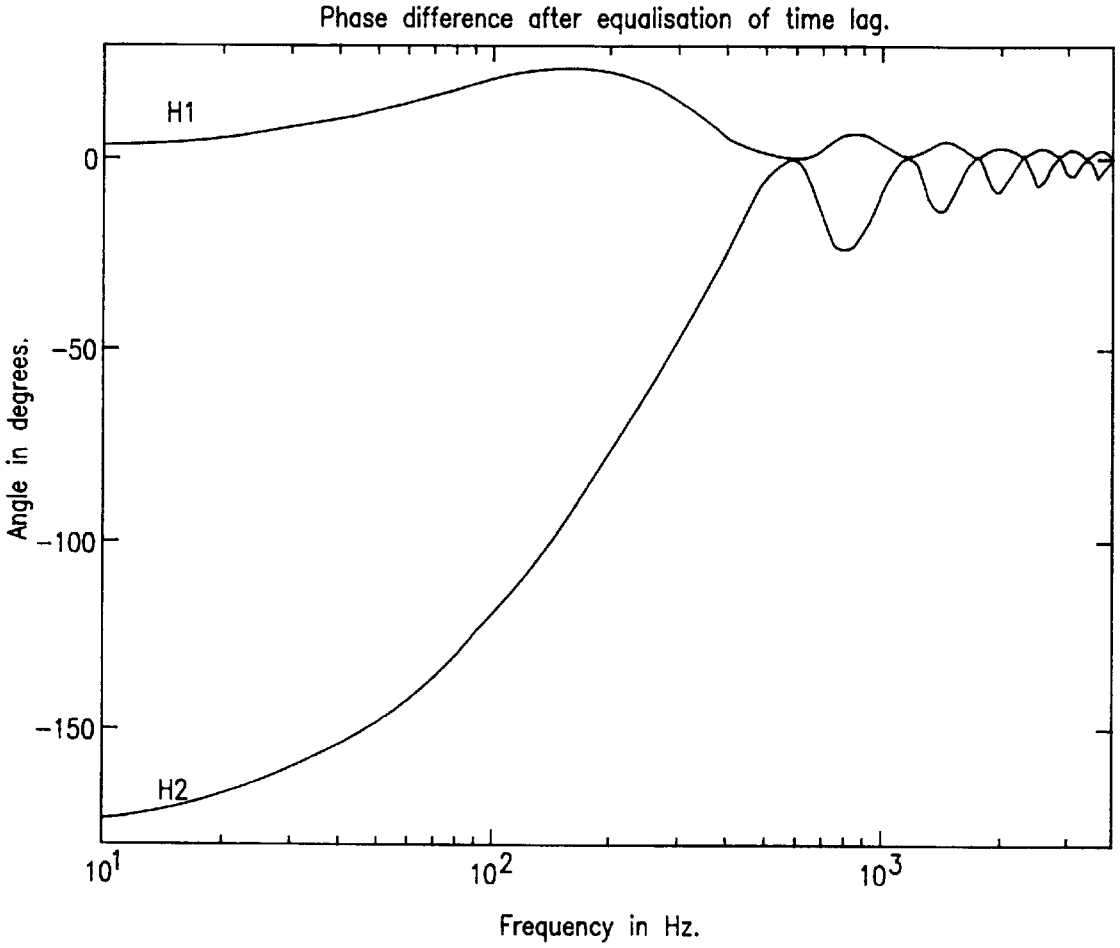
Figure 5:
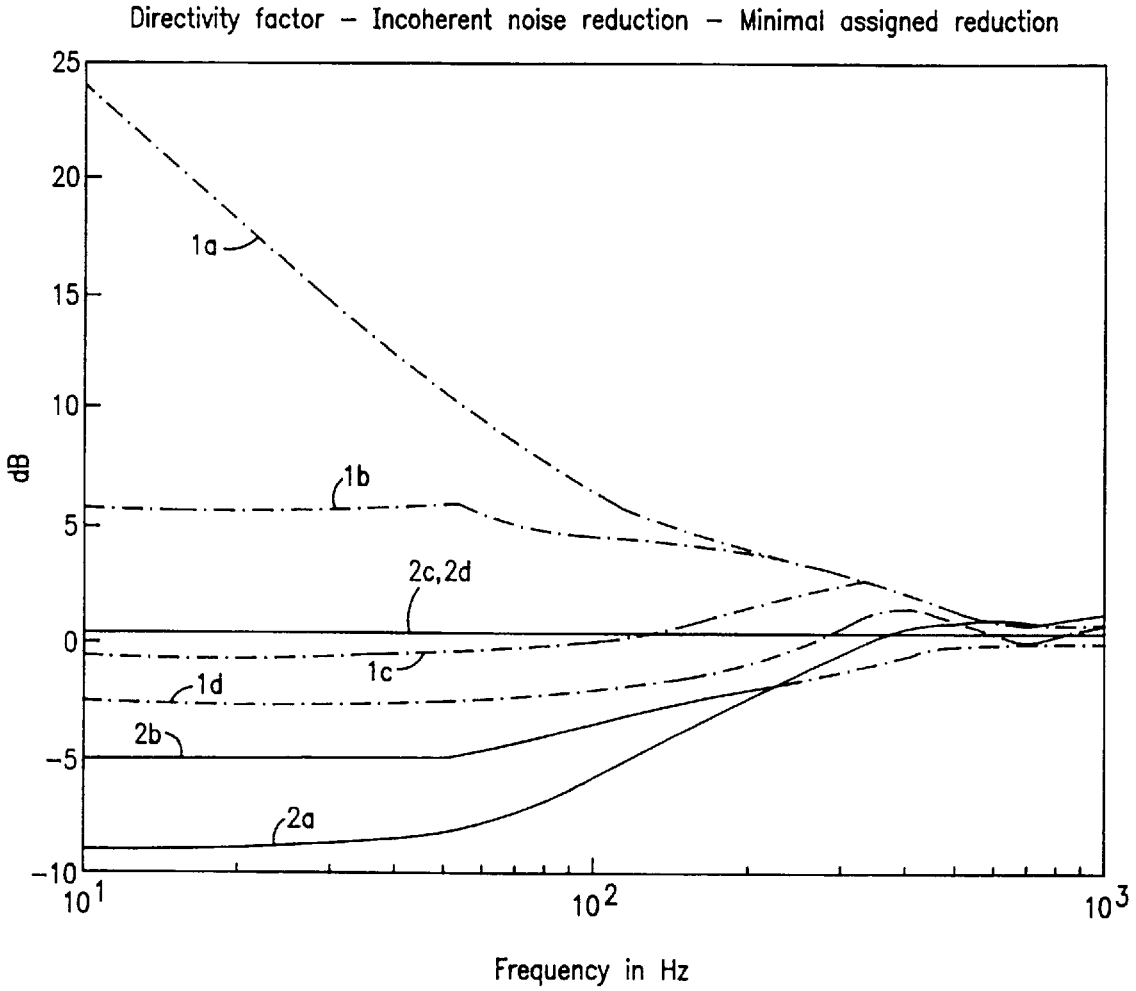
Figure 6:
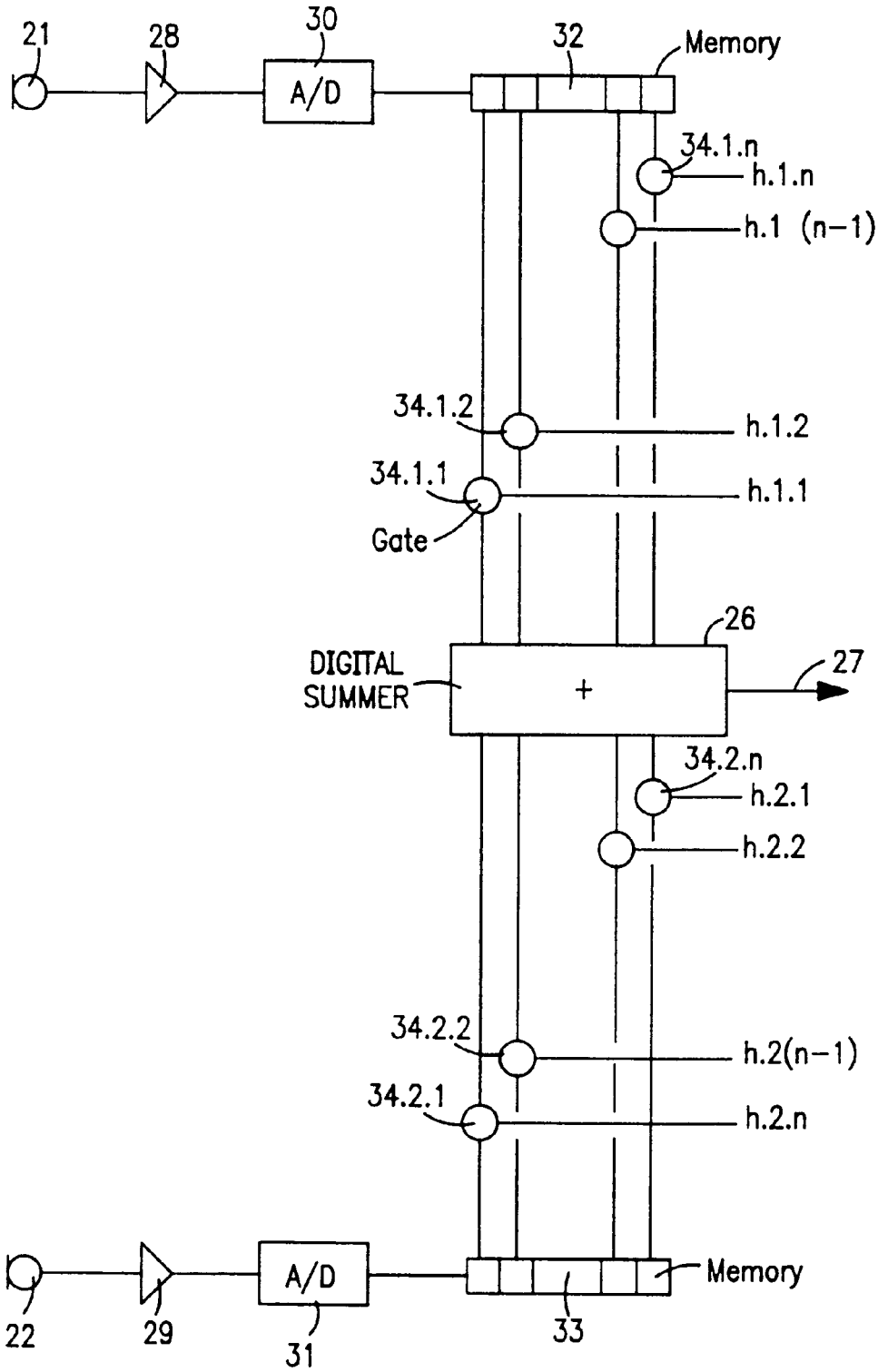
Figure 7:
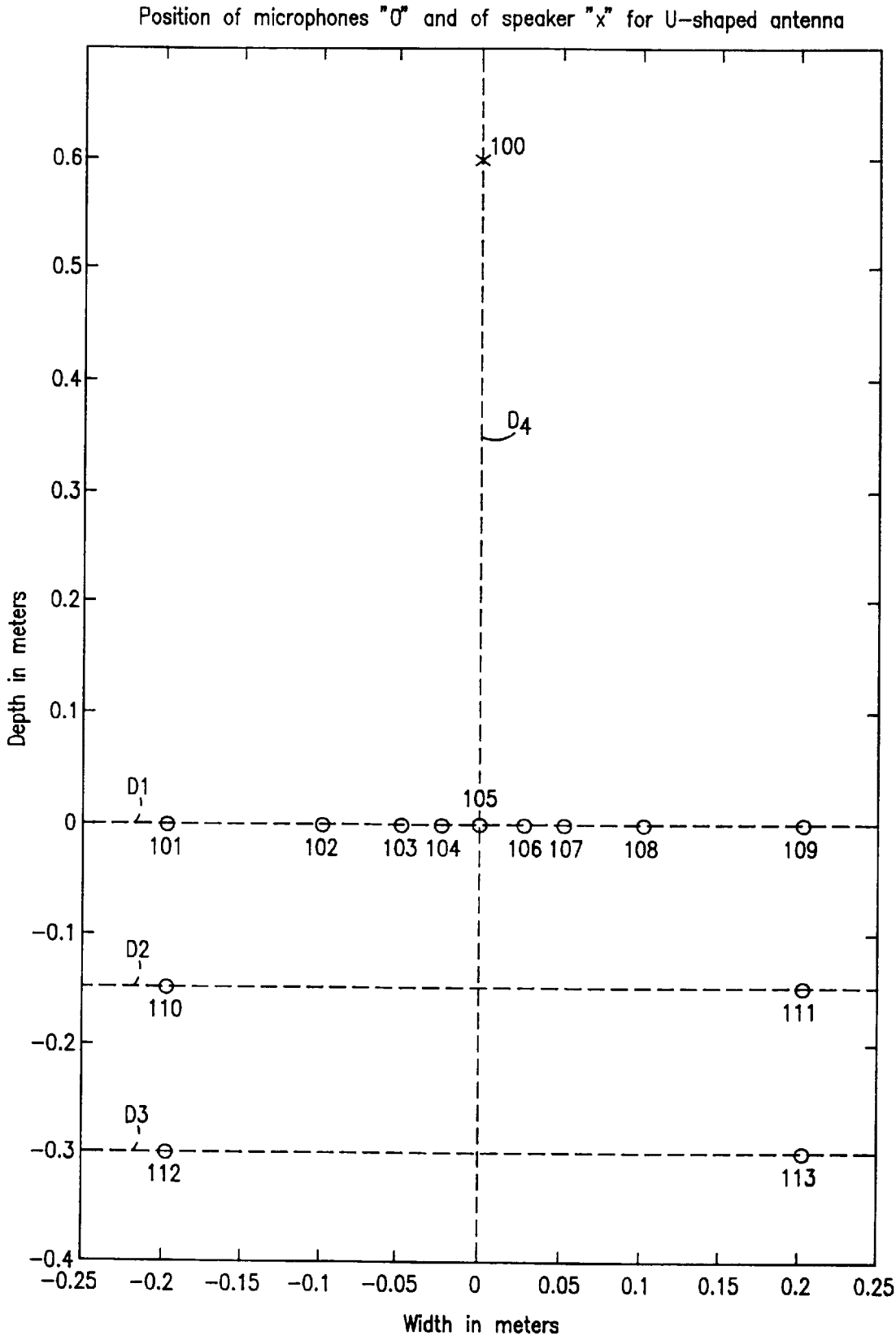
Figure 8:
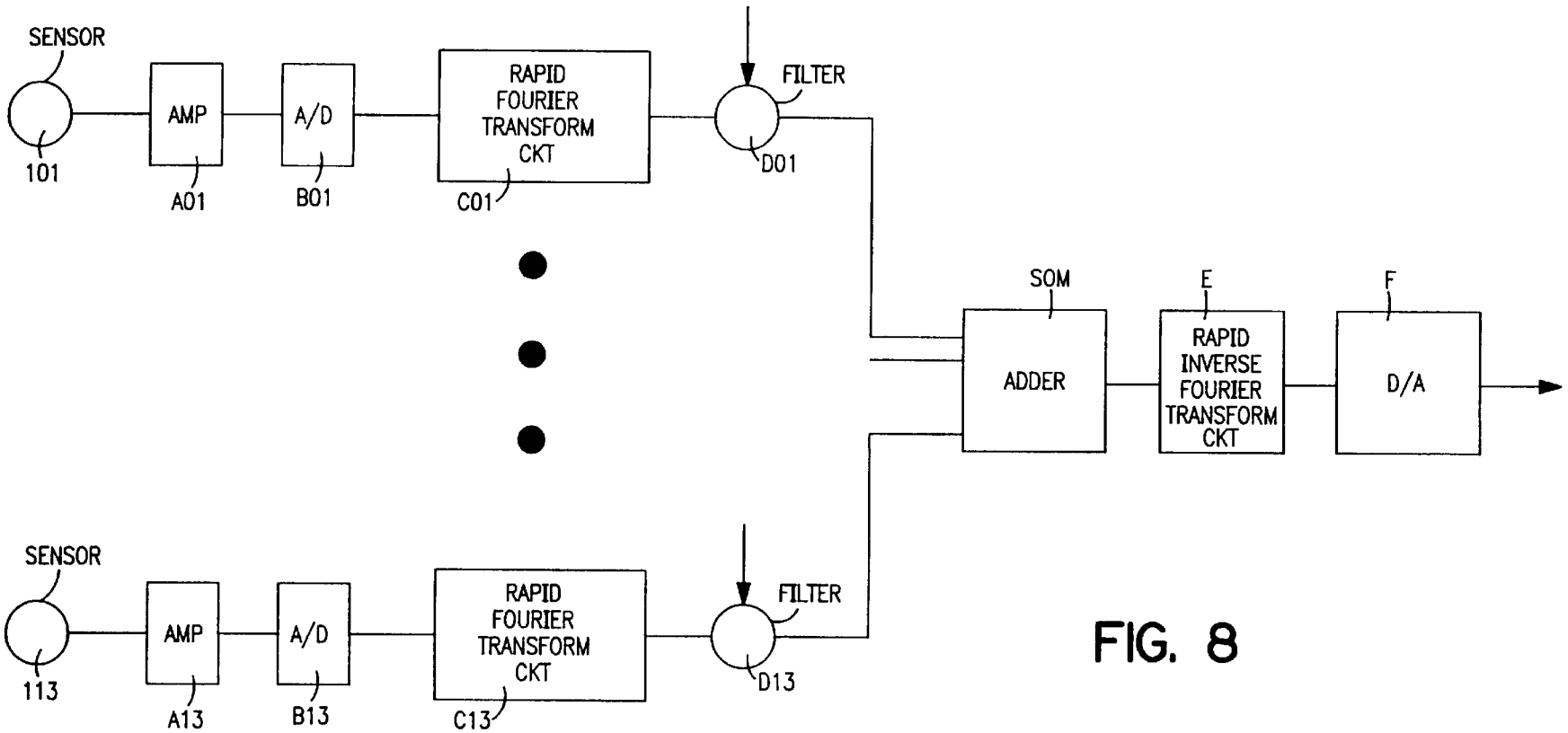
Figure 9:
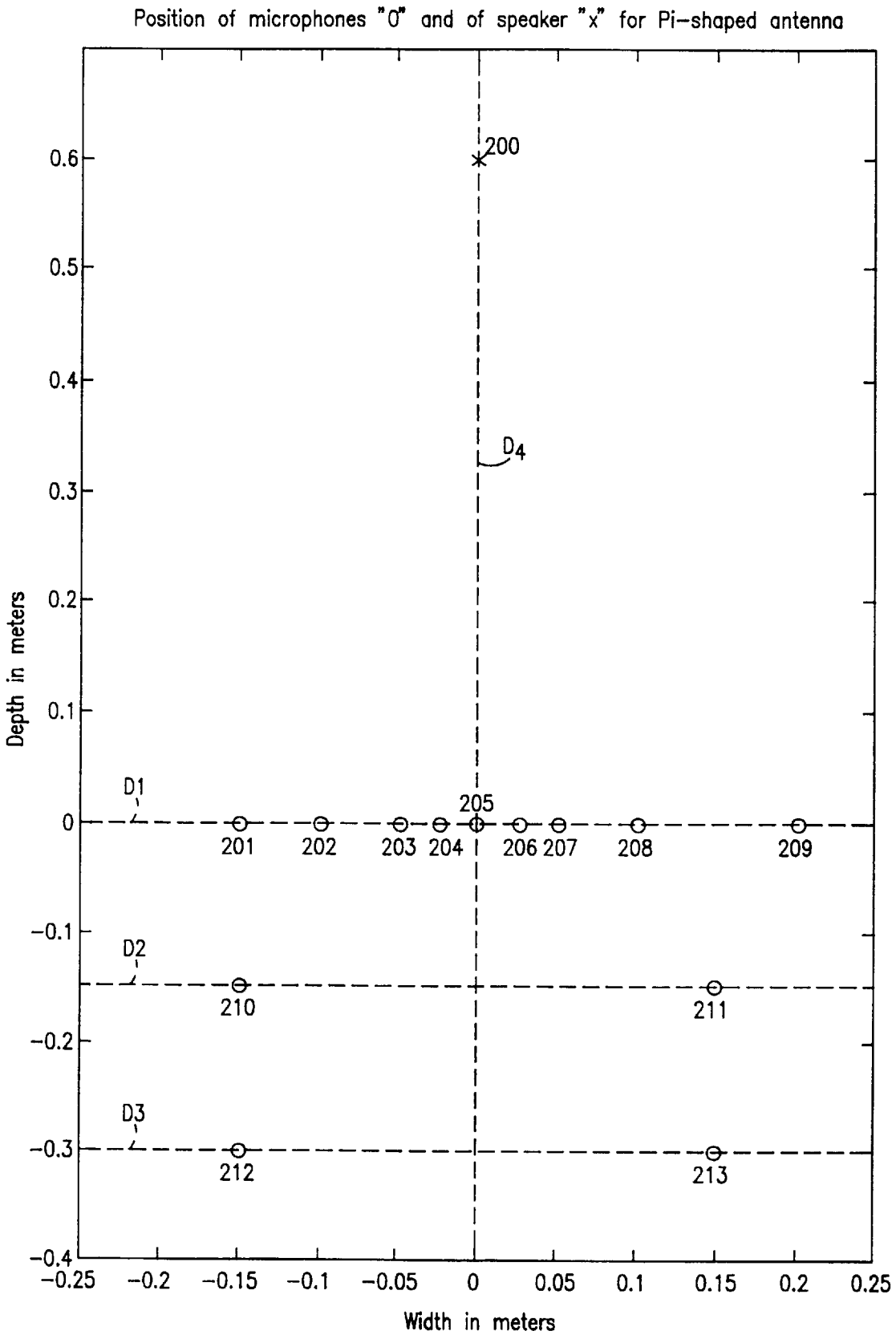
Figure 10:
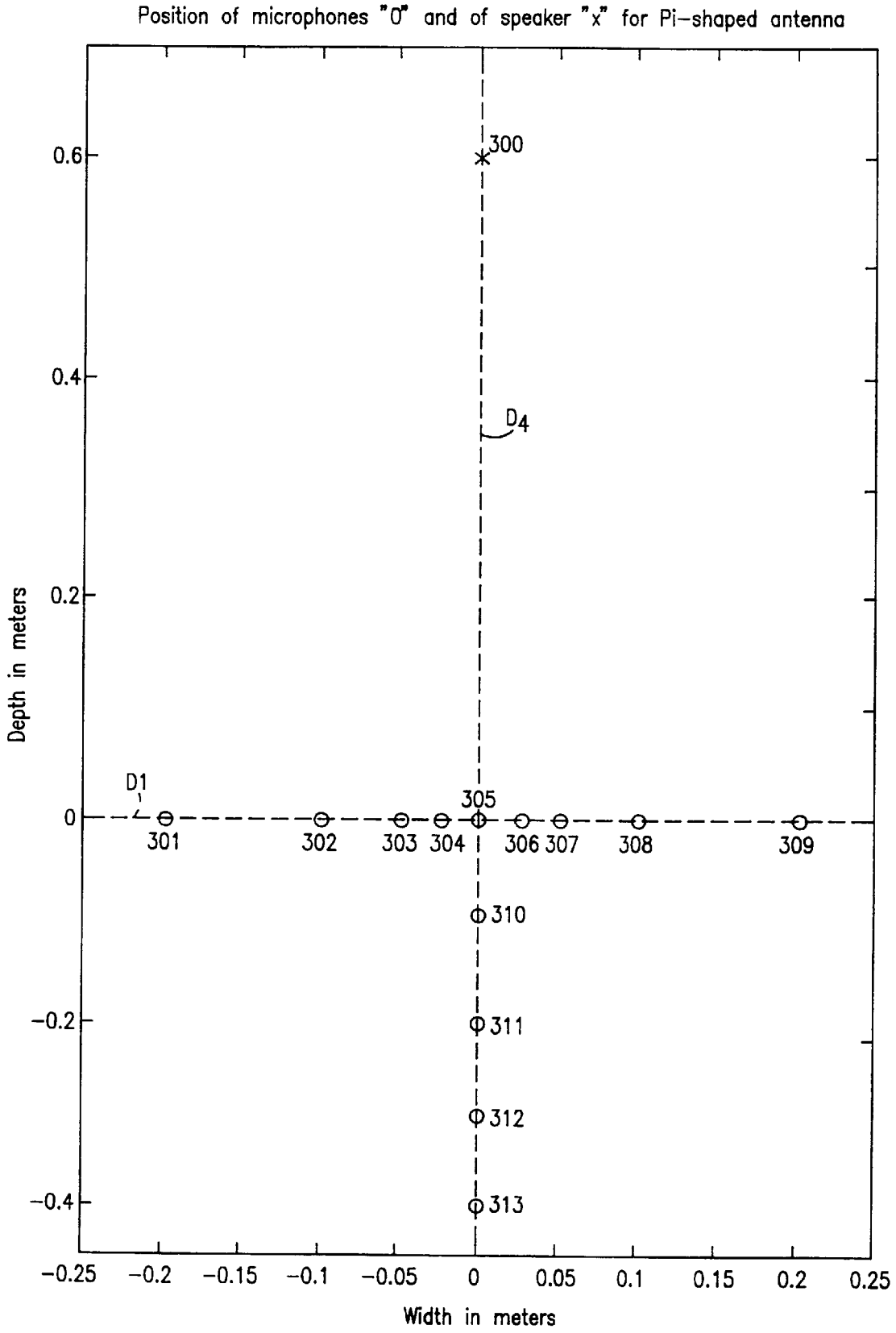

The characteristics of the present invention mentioned above, as well as others, will emerge more clearly from a reading of the description below of example embodiments, the said description being given with relation to the accompanying drawings, among which:

FIG. 1 is a diagram illustrating the processing of output signals from the acoustic sensors of any antenna of the invention, FIG. 2 is a schematic view of a .first example antenna according to the invention, FIGS. 3 and 4 depict respectively two modulus diagrams and two phase difference diagrams concerning the filters used in the antenna of FIG. 2, FIG. 5 is a schematic diagram of a circuit for processing output signals from the sensors of the antenna of FIG. 2, FIG. 6 depicts schematically three response curves as a function of frequency which are obtained according to three different hypotheses, FIG. 7 is a schematic view of a second example embodiment of a U-antenna according to the invention, FIG. 8 is the schematic diagram of a circuit for processing output signals from the sensors of the antenna of FIG. 7, FIG. 9 is a schematic view of a third example embodiment of a Pi-antenna according to the invention, and FIG. 10 is a schematic view of a fourth example embodiment of a T-antenna according to the invention.

FIG. 1 shows symbolically the SDMP flow diagram 10 which receives input data from a set 11 containing the digital data relating to the topographical layout of the antenna sensors and of the wanted source, from a set 12 containing the data relating to the linear constraints, from a set 13 containing the data relating to the spatial weighting, from a set 14 containing the data relating to the constraints on the chosen incoherent noise reduction, and from a set 15 containing the data relating to the sub-antenna definitions. The flow diagram 10 delivers output data to a set 16, the output data relating to a set of coefficients of M digital filters in the frequency domain, M being equal to the number of antenna sensors.

An exposition of the SDMP flow diagram of the invention which realizes the mathematical operator mentioned above is shown in the annex at the end of the present description. This flow diagram is described in MATLAB language, well known to persons skilled in the art.

Having the set of M filters in the frequency domain, either a filtering in the frequency domain with multiplication may be carried out, or a transformation by a conventional filter design algorithm, for example the algorithm of the "generalised least squares" type, in order to obtain a set of filters in the time domain, then a filtering in the time domain with convolution carried out.

In FIG. 2, the antenna is formed from two acoustic sensors or microphones 21 and 22 placed one behind the other with respect to a speaker or wanted acoustic source 23. The sensors 21 and 22 and the wanted source 23 are aligned. The distance d between the sensors is, for example, 30 cm and is equal to the distance from the sensor 21 to the source 23. This very simple antenna thus symbolises a picking up of near-field sound. Moreover, still with the aim of simplicity, it is assumed that the two sensors have an omnidirectional directivity diagram.

The outputs of the sensors 21 and 22 are respectively connected to the inputs of low-pass filters 24 and 25, the outputs of which are connected to the inputs of a summer 26 which delivers the antenna output signal at 27.

With a conventional processing - "equalization of the delay due to propagation, then summation"—at very low frequencies, the coherent perturbations coming from all directions are summed phase-wise, which quadruples the power, that is with the formula (2) above:

$$|G_2|^2=(1+1)^2=4$$

The wanted signal is also added phase-wise, but the amplitude of the signal on sensor 2 is half as large as on sensor 1, which leads to an amplification of the power of the wanted signal equal to:

$$|G_1|^2=(1+0.5)^2=2.25$$

and a directivity factor—formula (3) above—equal to:

$$(F(f=0)|)_{dB} = 10\log_{10}\left(\frac{2.25}{4}\right)dB = -2.5dB$$

If a subtraction is performed, instead of a summation as in the conventional processing, this gives:

$$|G_2|^2=(1-1)^2=0$$

a wanted signal:

$$|G_1|^2=(1-0.5)^2=2.25$$

Thus the directivity factor tends towards infinity if the frequency tends towards zero. On the other hand, the processing is less robust, since the wanted signal is weak at the output. Amplification of the signal amplifies everything which is not identical on the two sensors 1 and 2, that is to say the incoherent noise which is added power-wise:

$$1^2+1^2=2$$

which means an amplification of the incoherent noise compared to the wanted signal equal to:

$$\left(\frac{1}{R}|\right)_{dB} = 10\log_{10}\frac{2}{0.25} = 9dB$$

This amplification remains small compared to the infinite directivity factor. It appears that the processing of the invention makes it possible to find a compromise between the directivity factor and the amplification of the incoherent noise.

Three processings according to the invention have been examined in different hypothetical cases:

with hypothesis (a), there is no constraint for amplification of the incoherent noise, with hypothesis (b), an amplification of the incoherent noise between 0 and 5 dB is accepted, and with hypothesis (c), an incoherent noise reduction equal to the conventional solution is taken, that is to say $$\left(10\log_{10}\left(\frac{2.25}{2}\right)dB = 0.51dB\right).$$

Under hypothesis (a), low-pass filters 24 and 25 are used, for which the diagrams of the moduluses as a function of frequency are respectively shown in FIG. 3. It can be seen that, for f=0, the amplitudes of the two moduluses are equal, which bears out the above equalities. Beyond 400 Hz, the amplitudes decrease substantially from −4 dB to reach −12 dB for the filter 24 and −18 dB for the filter 25.

Still under hypothesis (a), in order to highlight the components of the wanted signal, the diagrams of phase difference as a function of frequency, FIG. 4, taking account of the fact of the delays, show that the responses of the filters 24 and 25 are in antiphase for f=0, but have practically the same value beyond 400 Hz.

The schematic diagram of FIG. 5 shows an example embodiment of a processing—filtering and summation—at the output of the sensors 21 and 22 in the time domain. The outputs of the sensors 21 and 22 are respectively connected to the inputs of microphone amplifiers 28 and 29, the outputs of which are respectively connected to the inputs of analogue-to-digital converters 30 and 31, the outputs of which are respectively connected to the inputs of memories 32 and 33 composed of shift registers having, for example, thirty-two cells each. The lateral output of a cell of the memory 30, associated with the sensor 24, is connected to one input of gate 34.1.n, the second input of which receives a coefficient signal h.1.n. The lateral output of a cell of the memory 31, associated with the sensor 25, is connected to one input of gate 34.2.n, the second input of which receives a coefficient signal h.2.n. The parameters n mentioned above vary discretely from one to thirty-two according to the rank of the cell in the shift register. The outputs of the gates 34.1.n and 34.2.n are connected to the corresponding inputs of a digital summer 26, the output of which delivers at 27 the antenna signal.

In FIG. 6, the variation in directivity factor as a function of frequency, under hypothesis (a), is shown by the curve 1*a*, which decreases from 25 dB to 5 dB below 100 Hz, and shows that the low-frequency performance is improved compared to that of a conventional antenna shown by the curve 1*d*. The curve 2*a* shows the variation in the reduction.

Still in FIG. 6, under hypothesis (b) where an amplification of the incoherent noise between 0 and 5 dB is accepted, the curve 1*b* shows that the low-frequency performance is improved to 5 dB, that is to say the conventional solution or solutions do not work well. The curve 2*b* corresponds to the variation in minimum reduction laid down.

Finally, under hypothesis (c) where an incoherent noise reduction equal to the conventional solution has been taken, the curve 1*c* shows that between 2 dB for the low frequencies and 0.6 dB for the high ones can be gained. The straight line 2*c* identical to the straight line 2*d* corresponds to the variation in minimum reduction laid down.

It may be noted, under these three hypotheses, that the greater the incoherent noise reduction, the less directive the antenna, and that the algorithm of the invention gives better results than the conventional solution 1*d* and 2*d*, comparing the curves 1*c* and 1*d*, and that the directivity factor can be high for the low frequencies.

A compromise between incoherent noise reduction and directivity factor can therefore be chosen.

FIG. 7 depicts schematically, opposite a wanted source 100, a U-antenna comprising thirteen sensors 101 to 113 which in the ex ample described are sensors with a cardioid directivity diagram directed towards the front, that is to say the region containing the source 100 with respect to the antenna. The first nine sensors 101 to 109 are aligned symmetrically around the sensor 105 on a first straight line D1, the next two sensors 110 and 111 a re disposed on a second straight line D2 and the last two sensors 112 and 113 on a third straight line D3. The straight lines D1, D2 and D3 are parallel and perpendicular to a straight line D4 passing through the sensor 105 and on which the wanted source 100 is installed. By way of example, the distance from the source 100 to the straight line D1 is 60 cm and the straight lines D2 and D3 are respectively placed behind the straight line D1 at 15 and 30 cm. The sensors 110 and 112 are aligned behind the sensor 101 and the sensors 111 and 113 are aligned behind the sensor 109 so as to form the legs of the U.

On the straight line D1, the intervals between the sensors 105, 104, 103, 102 and 101 vary increasingly in a logarithmic fashion and symmetrically with the intervals between the sensors 105, 106, 107, 108 and 109.

Between 105 and 104, the interval is 2.5 cm, between 104 and 103, it is 2.5 cm; between 103 and 102, 5 cm; and between 102 and 101, 10 cm. The sensor 110 is placed 15 cm behind the sensor 101, like 111 behind 109, and the sensor 112 is placed 15 cm behind the sensor 110, like 113 behind 112.

The schematic diagram of FIG. 8 illustrates the frequential implementation of the filtering of the output signals of the sensors 101 to 113 of FIG. 7. The sensor 101 feeds an amplifier A01 Followed by an analogue-to-digital converter B01 followed by a circuit C01 Operating according to the Rapid Fourier Transform algorithm (RFT with zero padding) connected to the serial input of a filter D01, the output of which is connected to a corresponding input of an adder SOM. The parallel input of the filter D01 receives the set of coefficients calculated by the SDMP flow diagram for this filter.

FIG. 8 shows the sensor 113 which feeds an amplifier A13 followed by an analogue-to-digital converter B13 followed by a circuit C13, operating like the circuit C01, connected to the serial input of a filter D13, the output of which is connected to a corresponding input of the adder SOM. The parallel input of the filter D13 also receives a set of coefficients calculated by the SDMP flow diagram.

The output of the adder SOM is connected to a circuit E operating according to an Inverse Rapid Fourier Transform algorithm (IRFT with Overlap Add) followed by a digital-to-analogue converter F which delivers the antenna output signal.

In practice, the algorithm can be implemented in real time using a DSP (Texas Instruments C50).

In practice, for the processing, the antenna of FIG. 7 is divided into four sub-antennas, the first three of which, in which the sensors 101 to 109 of the straight line D1 play a part, are used to cover three high-frequency octaves and the fourth, in which all the sensors 101 to 113 play a part, is used to cover the low frequencies from 0 to 1 kHz.

As mentioned above, on the straight line D1, the sensors 101 to 109 are distributed symmetrically in a logarithmic fashion, which makes it possible in a manner known per se to reduce the number of sensors, in this case to nine. A number of five sensors per octave band proves to be sufficient. The sensors 103 to 107, constituting the first sub-antenna, are used for the band 4 to 7 kHz; the sensors 102, 103, 105, 107 and 108, constituting the second sub-antenna, for the band 2 to 4 kHz; and the sensors 101, 102, 105, 108 and 109, constituting the third sub-antenna, for the band 1 to 2 kHz.

In the fourth sub-antenna, the processing involves all the sensors 101 to 113 using the algorithm of the invention, that is to say taking into account the modulus differences and phase differences on the sensors 110 to 113, in a manner similar to the processing mentioned above for the antenna of FIG. 2.

Thus the processing according to the invention is useful for a broad band of frequencies, for example for speech, a band going from 20 Hz to 7 kHz.

In FIG. 9, a variant of the antenna of FIG. 6 has, opposite a wanted source 200, thirteen sensors 201 to 213 with a cardioid directivity diagram. The first nine sensors 201 to 209 are aligned symmetrically around the sensor 205 on a first straight line D1, the next two sensors 210 and 211 are disposed on a second straight line D2 and the last two sensors 212 and 213 on a third straight line D3. The straight lines D1 to D3 are parallel and perpendicular to a straight line D4 passing through the sensor 205 and the wanted source 200. In the example shown, the mutual distances between the straight lines D1 to D3 and the source 200 are identical to those mentioned regarding the antenna of FIG. 6.

On the straight line D1, the mutual distances between the sensors 201 to 209 are identical to those which exist between the sensors 101 to 109.

The sensors 210 and 212 are aligned behind the middle of the segment 201–202 and the sensors 211 and 213 aligned behind the middle of the segment 208–209. Depth-wise, their mutual distances are the same as in FIG. 7. The displacements of the sensors 210 to 213 towards the centre of the antenna earns it the designation Pi-antenna.

The output signals of the Pi-antenna are processed according to the superdirective/modulus/phase flow diagram of the invention.

In FIG. 10, another variant of the antenna of FIG. 6 has, opposite a wanted source 300, thirteen sensors 301 to 313 with a cardioid directivity diagram. The first nine sensors 301 to 309 have, on the straight line D1, the same disposition as the first nine sensors of FIG. 6.

The last four sensors 310 to 313 are successively aligned along the same straight line D4 of FIG. 6, behind 305 so as to form, with the sensors 301 to 309, a T-antenna. The distance between the sensors 310 and 305 is equal to 10 cm, as between the sensors 311 and 310, between 312 and 311, and between 313 and 312.

The output signals of the T-antenna are processed according to the superdirective/modulus/phase flow diagram of the invention.

In variants, instead of giving the U-, Pi- or T-antennas, described above in relation to FIGS. 7, 8 or 9, a straight structure, they can be given an oblique structure, that is to say the straight lines D1, D2, D3 are no longer perpendicular to the straight line D4, but make a certain angle with it, the position of the wanted source still being aligned with the straight line D4.

FIG. 1 depicts a set 11 which contains the digital data relating to the topographical layout of the sensors of the antenna and of the wanted source. This set 11 also contains data relating to the propagation model and/or, as mentioned above, measurements of the pulse responses.

In the annex below, is shown, as already mentioned, an SDMP flow diagram written in MATLAB language.

ANNEX

```
%%%%%%% example of the use of the SDMP algorithm %%%%%%%%%%%%
%
% this file contains two parts:
%
% the SDMP part contains
%
% the geometry of the problem (antenna, speaker position, interference unit
% position)
% the linear constraints for the speaker and the interference unit
% the non-linear constraint for the incoherent noise reduction
```

-continued

ANNEX

```
%
% at the end of the SDMP part, the algorithm makeG is called
%
% the conventional antenna part is a delay/weighting/sum lobe formation algorithm
%%%%%%%%%%%%%% SDMP antenna part %%%%%%%%%%%%%%%%
%%%%% definition of the geometry of the antenna and speaker position and of an
        % interference unit
GeometryFile='g3.geo';    % contains position, orientation and cardio factor of
                          % the microphones
am=1:13;                  % sensors used
M=length(am);
FocusingPoint=[0 .6 0];   % speaker position in meters => pure delay constraint
InterferenceUnitPoint=[10 10 0];  % interference unit position => zero in the
                                  % required diagram
%%%%%%%%%%%%% propagation
PropagationModel='PropModel';     % this function must be called to obtain
                                  % delay and attenuation
[focdlay focatt]=eval([PropagationModel '(GeometryFile,am,FocusingPoint, 1)']);
                                  % for speaker
focdlay=focdlay-min(focdlay);     % remove additional fixed delay
NormalizationFactor=max(focatt);  % normalize attenuation
focatt=focatt/NormalizationFactor;
[iudlay iuatt]=eval([PropagationModel '(GeometryFile,am,InterferenceUnitPoint,0)']);
                                  % ditto for interference unit
iuatt=iuatt/NormalizationFactor;
iudlay=iudlay-min(iudlay);
%%%%%%%% frequencies for which the filters are calculated with SDMP algorithm
FrequencyVector=[0:25:900];
NoOfFrequencies=length(FrequencyVector);
SamplingFrequency=16000;
SubAntenna=repmat(an,NoOfFrequencies, 1);
%%%%% constraint for the incoherent noise reduction (as a function of frequency)
TransitionFrequency=sum(FrequencyVector<700);     % for sdmp->conventional
                                                  % antenna transition
IncoherentNoiseReduction=[-2*ones(1,TransitionFrequency) linspace(-
2,5,NoOfFrequencies-TransitionFrequency)];
%%%%%%%%%%%% constraints for speaker and interference unit
ConstraintMatrixPrefix='Cm';      % Cm1, Cm2, . . . (for all
                                  % frequencies in FrequencyVector)
ConstraintVectorPrefix='Cv';      % Cv1, Cv2, . . .
fc=0;
for f=FrequencyVector
    fc=fc+1;
    Constraint1=(focaff(am).*exp(2i*pi*f*focdlay(am)));     % conjugate of the
                                                            % propagation vector
    Constraint2=(iuatt(am).*exp(2i*pi*f*iudlay(am)));       % ditto for
                                                            % interference unit
    eval(['global Cm' int2str(fc)]);
    eval(['global Cv' int2str(fc)]);
    eval(['Cm' int2str(fc) '=[Constraint1,Constraint2];']);
    eval(['Cv' int2str(fc) '=[1;0];']);
end
%%%%%%%%%% definition of the step for approximating the integration by a sum
dphi=pi/25;
dtheta=pi/6;
%%%%%%%%%%% calling of the SDMP algorithm
G = makeG(GeometryFile,PropagationModel,FrequencyVector, SamplingFrequency,
SubAntenna, IncoherentNoiseReduction, ConstraintMatrixPrefix,
ConstraintVectorPrefix, dphi, dtheta)
frp32 FrequencyVector; % the frequencies of the conventional part are added to this later
%%%%%%%%%%%%%%% conventional antenna part %%%%%%%%%%%%%%%
% design of a conventional antenna for the high frequencies
% applied to the 9 microphones in front (3 sub-antennas out of 5)
% sub-antenna definition
antmic(1,:)=[1 2 5 8 9];    % 950–1800Hz band
antmic(2,:)=[2 3 5 7 8];    % 1800–3600Hz band
antmic(3,:)=[3:7];          % 3600–8000Hz band
% sub-band limit frequency definition
fmin=[950 1800 3600];       % lower limits
fmax=[1800 3600 8000];      % upper limits
width=fmax-fmin;            % bandwidths
% weighting for more or less constant main lobe aperture
win1=[.6;.9;1;.9;.6];
win2=hamming(5),
no_of_pts=50;          % points per band
fc=length(fr);         % weightings for 1:fc already calculated by superdir. algorithm
for band=1:3
```

-continued

ANNEX

```
    band
    am=antmic(band,:);
    [tau0,att0]=PropModel(GeometryFile,am,FocusingPoint, 1);
    tau0=tau0-min(tau0);
    ctr=0;
    for f=fmin(band)+width(band)/no__of__pts:width(band)/no__of__pts:fmax(band)
        fc=fc+1;
        fr(fc)=f;
        f
        % weighting for more or less constant main lobe aperture
        smooth=1-ctr/no__of__pts;
        b=smooth*win1+(1-smooth)*win2;
        b=b/sum(b);
        cp=b.*exp(2i*pi*f*(tau0/SamplingFrequency));
        G(fc,am)=cp.';
        ctr=ctr+1;
    end
end
%%%%%%%%%%%%%%% calculation %%%%%%%%%%%%%%%%%%%
function G = makeG(GeometryFile,PropagationModel,FrequencyVector,
SamplingFrequency, SubAntenna, IncoherentNoiseReduction, ConstraintMatrixPrefix,
ConstraintVectorPrefix, dphi, dtheta)
%
% GeometryFile is a file which contains the geometry of the antenna such that
% PropagationModel can calculate the delay and attenuation due to the propagation
% FrequencyVector (1,NumberOfFrequences): Contains the frequencies for which
% the filters are calculated
% SubAntenna: (NumberOfSensors,NumberOfFrequencies) Describes which sensors
% are used at each frequency
% IncoherentNoiseReduction: Minimum required incoherent noise reduction
% ConstraintMatrixPrefix: Prefix for obtaining the linear constraint matrices
% ConstraintVectorPrefix: Prefix for obtaining the linear constraint vectors
%
% G (NumberOfSensors,NumberOfFrequencies): filter in the frequency domain
[xm,ym,zm,mictype,xo,yo,zo,mcardio]=readgeo(GeometryFile);   % reading of the
                                                             % geometry
M=length(xm);                                          % number of sensors
G=zeros(M,length(FrequencyVector));
fc=0;
pr=0:dphi:(2*pi-eps);                  % phi angles (azimuth) vector
tr=(dtheta/2):dtheta:(pi-dtheta/2+eps);  % theta angles (elevation) vector
sr=-[logspace(-7,7,800)];              % vector for finding parmeter for INR
%%%%%%%%% calculation of the filters frequency by frequency
for f=FrequencyVector
    f                                  % frequency display
    fc=fc+1
    eval(['global Cm' int2str(fc)]);   % constraint matrix for this frequency
    eval(['global Cv' int2str(fc)]);   % constraint vector for this frequency
    [am,Msa]=getam(SubAntenna,fc);       % sub-antenna for this frequency
    r=1e4;                               % 10km = far-field
    fac=2i*pi*f;
    D=zeros(Msa);
    %%%%%%%%%%% integration over all directions
    for theta=tr
        st=sin(theta);
        for phi=pr
        p=r*[cos(phi)*st sin(phi)*st cos(theta)];      % far-field point
        [dlay(am),att(am)]=eval([PropagationModel'(GeometryFile,am,p,0)']);
        att=att*r;
        d2=att(am).*exp(-fac*dlay(am));
        D=D+d2'*d2*st;
    end
end
D=D*dphi*dtheta+eps*eye(size(D));   % +eps*eye to avoid extreme
                                    % conditioning
Cm=eval([ConstraintMatrixPrefix int2str(fc)]);
Cv=eval([ConstraintVectorPrefix int2str(fc)]);
%%% loop for finding direction parameter which provides a sufficient incoherent
%%% noise reduction
sc=0;
INR=-Inf;
while sc<=length(sr)-1 & INR<IncoherentNoiseReduction(fc)
    sc=sc+1;
    direction=sr(sc);
    KiC=(1)-direction*eye(Msa))\Cm;
    b=KiC/(Cm'*KiC)*Cv;
    INR=10*log10(1/(b'*b));
```

-continued

ANNEX

```
end
if sc==length(sr)
        b=Cm*inv(Cm'*Cm)*Cv
        'warning: Incoherent Noise Reduction impossible'
    end
    G(am,fc)=b;   % store result b for the frequency examined in a matrix G
end
%%%%%%%%%%%%%%%% reading of geometry %%%%%%%%%%%%%%
function [xm,ym,zm,mictype,xo,yo,zo,mcardio]=readgeo(geoname)
%
% function [xm,ym,zm,mictype,xo,yo,zo,mcardio]=readgeo(geoname)
%
% used to load an antenna geometry stored in geoname:
%
% xm,ym,zm:       Sensor positions
% mictype:    Microphone type ('omni', 'cardio', etc)
% xo,yo,zo:    Orientation of the microphones
% mcardio: cardio factor if cardioid
str=['/users/cmc/tager/geometries/' geoname];  % complete filename
fid=fopen(str);
if fid<0
    error('file not found')
end
% read microphone type (character string terminated with 0)
Maxlength=100;
i=0;
while i<Maxlength
    i=i+1;
    mictype(i)=fread(fid,1,'char');
    if mictype(i)==0
        break;
    end
end
mictype=setstr(mictype(1:i-1));
% read number of sensors
M=fread(fid,1,'short');
% read positions
xm=fread(fid,M,'float')';
ym=fread(fid,M,'float')';
zm=fread(fid,M,'float')';
% read orientations
xo=fread(fid,M,'float')';
yo=fread(fid,M,'float')';
zo=fread(fid,M,'float')';
% read cardio factors
mcardio=fread(fid,M,'float')';
fclose(fid);
%%%%%%%%%%%%%%% propagation model %%%%%%%%%%%%%%
function [dlay,att]=PropModel(GeometryFile,am,p,always)
% sound wave propagation model
% delay=distance/speed
% attenuation=sensor_attenuation * distance_attenuation
global GeometryRead xm ym zm mcardio MO
% read geometry if not yet known
if ~exist('GeometryRead') | always
    [xm,ym,zm,mictype,xo,yo,zo,mcardio]=readgeo(GeometryFile)
    MO=[xo;yo;zo];
    GeometryRead=1
end
tau=[ ];atten=[ ];
c=340;            % speed of sound
M=length(xm);   % number of sensors
for m=am
    vec_m_p=p-[xm(m) ym(m) zm(m)];  % source-microphone m vector
    dist=norm(vec_m_p);                % distance
    cosangl=vec_m_p*MO(:,m)/(dist*norm(MO(:,m)));
    dlay(m,1)=dist/c;                                  % delay
    att(m,1)=(1+mcardio*cosang;)/(dist*1+mcardio));    % atten.
end
dlay=dlay(am);
att=att(am);
```

What is claimed is:

1. A method of providing an acoustic antenna formed from M discrete acoustic transducers having output signals respectively subjected to filters processing $g(f)=(g_1(f), \ldots, g_M(f))$ wherein the method comprises:

a step for maximizing a directivity factor which depends on (1) the modules $A(f)-(\alpha_1^H(f)\alpha_1(f)$ of the signals that are emitted by a near-field source and respectively received by said transducers, and (2) the modules $d_2(f)$ of signals that are emitted by a perturbing source and respectively received by said transducers, said directivity factor being given by:

$$F(f) = \frac{g(f)A(f)g^H(f)}{g(f)D(f)g^H(f)}$$

where A(f) is a matrix equal to:

$$A(f)=a_1^H(f)a_1(f)$$

and, where D(f) is equal to:

$$D(f) = \frac{1}{4\pi}\int_{\varphi}\int_{H} d_2(f)d_2^H(f)\sin\theta d\varphi d\theta$$

said maximizing step comprising a linear unit gain for the signal emitted by the near field source given by the following relation:

$$g(f)a_1^H(f)=e^{-j2\pi fc}$$

where $\tau$ is a constant representing a pure delay.

2. The method of providing an acoustical antenna according to claim 1, wherein said maximizing step comprises a non-linear factor which fixes a value $R_{min}$ for an incoherent noise reduction given by the following relation:

$$g(f)g^H(f) < \frac{1}{R_{\min}}.$$

3. The method of providing an acoustical antenna according to either claim 1 or claim 2 wherein said maximizing step comprises a linear constraint which forces attenuation and zeros in given directions of the directivity defined by the following relation:

$$C(f)g^H(f)=p(f)$$

where C(f) is a matrix of propagation vectors for the directions of the space concerned with this constraint and p(f) represents the transfer functions for these directions.

4. Antenna according to claim 3, characterised in that there are direction of rows of sensors in first and second parts, the rows being transverse to the mean direction of the wanted acoustic waves.

5. Antenna according to claim 3, characterised in that there are rows of sensors in first and second parts, the rows being slightly oblique with respect to the mean direction of the wanted acoustic waves.

6. Antenna according to one of claims 4 and 5, characterised in that the sensors of the first part are distributed symmetrically in a logarithmic manner around the median sensor.

7. Antenna according to claim 6, characterised in that the sensors of the first part are selectively allocated to a number of sub-antennas, each sub-antenna being associated with a pre-determined frequency band and the sensors selectively allocated to this sub-antenna delivering output signals which are processed by a conventional processing, the frequency bands being contiguous and as a whole not going below 1 kHz in practice, each processing consisting of a specific filtering and the output signals of each specific filter being summed.

8. Antenna according to claim 7, characterised in that each sensor output signal is filtered by a filter which performs all of the following: the SDMP algorithm for the low frequencies, division into frequency bands according to the logarithmic antenna method, and conventional channel formation for the frequencies not processed according to the SDMP algorithm.

9. Antenna according to any one of claims 3 to 8, characterised in that a propagation model is used.

10. Antenna according to any one of claims 3 to 8, characterised in that a measurement of the propagation vectors is used.

11. An acoustical antenna made by the method according to one of the claims 1–3.

* * * * *